US007567213B2

(12) United States Patent
Liu

(10) Patent No.: US 7,567,213 B2
(45) Date of Patent: Jul. 28, 2009

(54) ARRAY STRUCTURE FOR THE APPLICATION TO WIRELESS SWITCH OF WLAN AND WMAN

(75) Inventor: I-Ru Liu, Taipei (TW)

(73) Assignee: Accton Technology Corporation, Hsinchu (TW)

( * ) Notice: Subject to any disclaimer, the term of this patent is extended or adjusted under 35 U.S.C. 154(b) by 430 days.

(21) Appl. No.: 11/381,179

(22) Filed: May 2, 2006

(65) Prior Publication Data

US 2007/0257858 A1 Nov. 8, 2007

(51) Int. Cl.
*H01Q 21/00* (2006.01)

(52) U.S. Cl. ..... 343/853; 343/893; 342/373

(58) Field of Classification Search ..... 343/853, 343/893; 342/373
See application file for complete search history.

(56) References Cited

U.S. PATENT DOCUMENTS 3,295,134 A * 12/1966 Lowe ..... 342/368
3,573,837 A * 4/1971 Reindel ..... 343/778
3,731,315 A * 5/1973 Sneleg ..... 342/373
3,736,592 A * 5/1973 Coleman ..... 342/370
5,812,089 A * 9/1998 Locke ..... 342/373

* cited by examiner

*Primary Examiner*—Tho G Phan
(74) *Attorney, Agent, or Firm*—Kusner & Jaffe

(57) ABSTRACT

The present invention provides an antenna array structure which includes multiple array elements, and the antenna array structure is using for the application of the WLAN (wireless local area network) or WMAN (wireless metro area network.) Furthermore, the array elements of the present invention are phased arrays or attenuated arrays, and when configuration with different type of the array element is used, the corresponding BFN (beam forming network) can also be implemented in various possibilities. With all the configuration of the present invention, the manufacturers can have a stable array structure for their applications.

14 Claims, 22 Drawing Sheets

Side-view of Circular Array

Side-view of Cylindrical Array

Side-view of Stacked and Interleaved Circular Array

Side-view of Stacked and Interleaved Cylindrical Array

ARRAY STRUCTURE FOR THE APPLICATION TO WIRELESS SWITCH OF WLAN AND WMAN

FIELD OF THE INVENTION

The present invention relates to antenna array structure, and more particularly the present invention relates to antenna array structure for the application to wireless switch.

BACKGROUND OF THE INVENTION

Since the network services became an important part of daily life, the worldwide manufacturers of the network devices put all their attention to build a faster and stable network environment. Users generally divide the network into two different formats; one is wired network environment, and another is wireless network environment. In the field of the wired network environment, for example the Ethernet which is supported by huge numbers of network products, there are many well-defined products for public, so users can build up a reliable wired network environment with little efforts. However, the twisted network cables always bother users, and it looks uncomfortable for everyone. The introduction of the wireless network environment solves the bothering problems, and the wireless technologies grow in a tremendous progress.

Just like the concepts in wired network, the wireless network is built under similar topology of the Ethernet, and many manufacturers start to follow up some industrial standards of WLAN, for example IEEE 802.11, WMAN and IEEE802.16. It becomes so easy for general users to build a wireless network environment in their homes, but the solution is hardly to meet the necessaries in enterprises' and outdoor hotspot's environments. The basic design of the wireless device is like the hub in Ethernet, and this means when the total throughput of the wireless device is over certain amount, and the performance of the wireless network will reduce largely. Because the traditional wireless device, for example Access Point (AP), is designed to be a wireless hub instead of a wireless switch. Formerly engineer only needed to redesign the internal circuit of wired hub, and the overall performance of the hub can be highly improved. In this manner, the hub was eventually replaced by the switch, and it is all about the performance. However, in the field of the wireless network, reaching the solution is a great challenge. Because of the outside factors in the wireless network environment, the characteristic of traditional "input/output (I/O) line" is difficult to be substituted. In wired network environment, the I/O line is coaxial wire, and the performance of the wired network can be improved by skimpily upgrading the quality of the coaxial wire.

In wireless network environment, improvement of the network I/O quality can not be done by this simple method. Because the network I/O is carried by radio frequency (RF,) so the quality of network I/O is highly dependent from antenna design. Plurality of sectored linear (planar) arrays with equal number of the Rotman lens may used as a solution; either dead or overlapped annoying zones within sector crossover regions can be found. It is urgent to have some modular antenna units and corresponding transmission devices in order to implement wireless switch.

SUMMARY OF THE INVENTION

The present invention fills the needs by providing antenna structures for the application to wireless switch of WLAN (wireless local area network) or WMAN (wireless metro area network). It should be appreciated that the present invention can be practical in various applications. Moreover, the antenna structures of the present invention provide better signal sources, and the signal sources can be further processed to meet manufacturers' needs. The most important factors in antenna design are the antenna gain and the transmission loss. The gain of the antenna must be kept always high, and the transmission loss of the antenna should be as low as possible. The antenna structure of the present invention provides a higher efficiency, but also matches lower budget of the development of new wireless device. In the other hand, the present invention is designed for cost effectiveness.

The present invention composes of 16 antenna elements to be a circular or a cylindrical array structure, and each antenna element is coupled to the relative antenna port at the beam forming network. The beam forming network is implemented by multiple Butler Matrices with port number less than the number of antenna elements, and the preferred antenna element is phased antenna array. When the array structure is a circular configuration, the covered area of the array structure is cylindrical. Moreover, when the array structure is configured in cylinder, the covered area of the array structure is circular. The arrangement between every Butler Matrix can be contiguous or staggered, and the detail information of the arrangement will descript in later paragraph. When the array structure of the present invention is used for application of the wireless network, the output (beam port) of the beam forming network is coupled to a network module, wherein the network module can be implemented by the network switching circuits of the vendors. Furthermore, the one significant utilization of the structure array of the present invention is to provide a directional finding scheme, and the directional finding scheme of the array structure using phased arrays is by phase-comparison. With the support of the directional finding scheme, the manufacturers can use this function of the array structure to implement more application for their products. In addition, the beam forming network with the phased arrays can be implemented by 90° hybrid couplers, and the choices between two different implementations of the beam forming network are based on the further application of the array structure. As well, the beam forming network can further be implemented in other applicable manners.

Moreover, the antenna elements of the present invention also can be replaced by attenuated arrays. When the antenna elements are attenuated arrays, the corresponding beam forming network should be replaced by microwave comparators. The directional finding scheme of the array structure using attenuated arrays is by amplitude-comparison. In addition, the beam forming network with the attenuated arrays can be implemented by Magic-T combiner/splitter, and the choices between two different implementations of the beam forming network are based on the further application of the array structure. As well, the beam forming network can further be implemented in other applicable manners.

BRIEF DESCRIPTION OF THE DRAWINGS

FIG. 12-1, FIG. 12-2 and FIG. 12-3 are block diagrams, which illustrate the selected beam from the FIG. 11.

FIG. 14-1, FIG. 14-2 and FIG. 14-3 are block diagrams, which illustrate the selected beam from the FIG. 13.

DETAILED DESCRIPTION OF THE PREFERRED EMBODIMENT

The present invention is described with preferred embodiments and accompanying drawings. It should be appreciated that all the embodiments are merely used for illustration. Although the present invention has been described in term of a preferred embodiment, the invention is not limited to this embodiment. It will be understood, however, to one skilled in the art, that the present invention may be practiced without some or all of these specific details. In other instances, well known process operations have not been described in detail in order not to unnecessary obscure the present invention.

Figure 1:
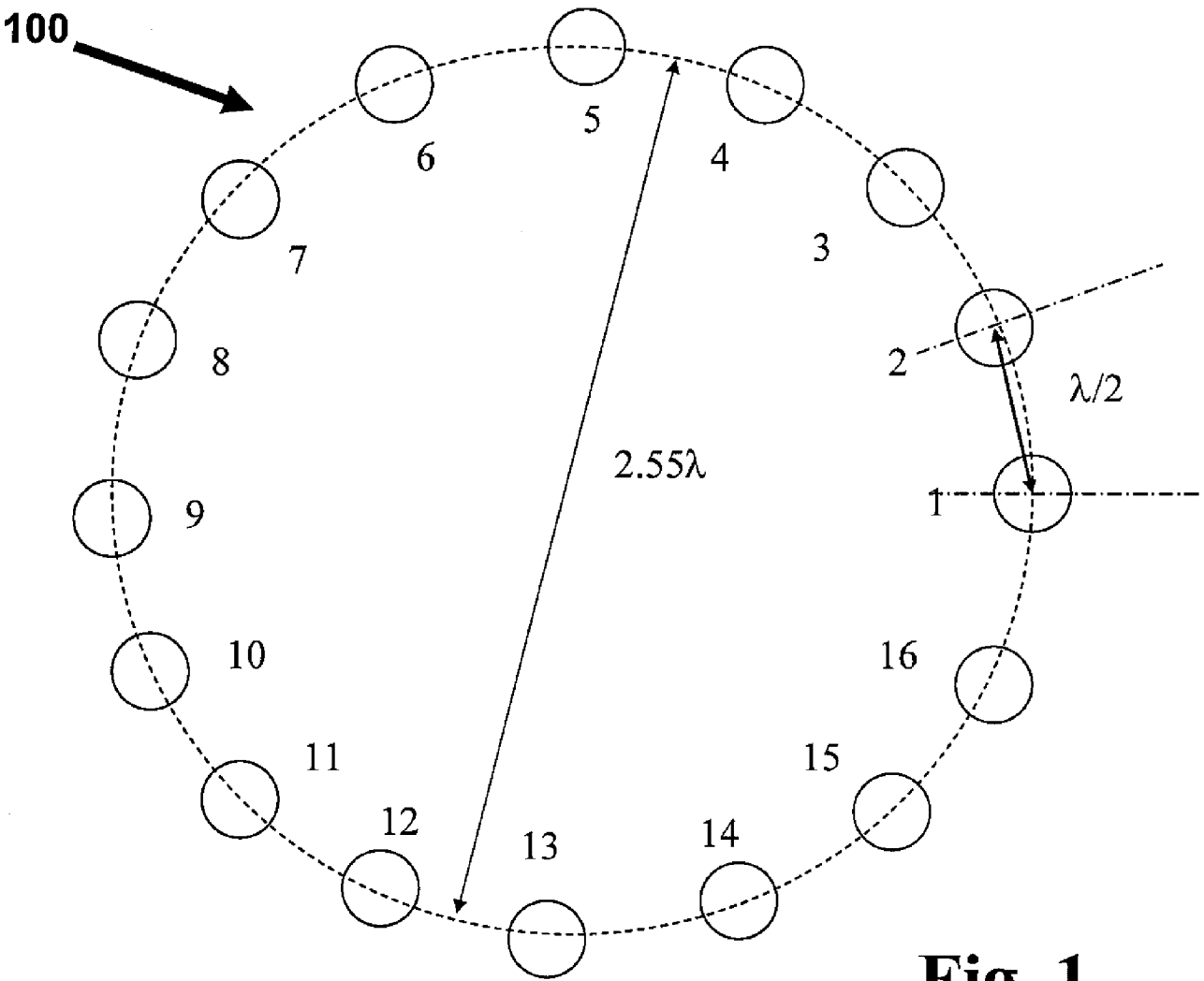
FIG. 1 is a block diagram, which illustrates an exemplary array structure with 16 phased array elements in accordance with one embodiment of the present invention.

Referring to FIG. 1, which is a diagram, illustrates an exemplary array structure with 16 phased array elements of the present invention. The phased arrays are configured in a close loop in a circle or cylinder shape with diameter greater than the wavelength of the array element. For example, when 16 phased array elements are equipped in a circular configuration as shown FIG. 1, the spacing between each element is about 0.5λ (λ representing the wavelength of the radio wave) and the diameter of the circle loop is around 2.55λ. If there are 32 phased array elements mounted on a circle, the spacing between each element is approximately 0.5λ and the diameter is around 5.09λ. The numbers of mounted elements are dependent from the further application, and the suggestion configuration is 16 elements when using for wireless switch. The spacing between each element also enhances the orthogonality of formed beam. Please be noted, the number of the antennas could be modified, and it is an embodiment rather than a limitation.

Figure 2:
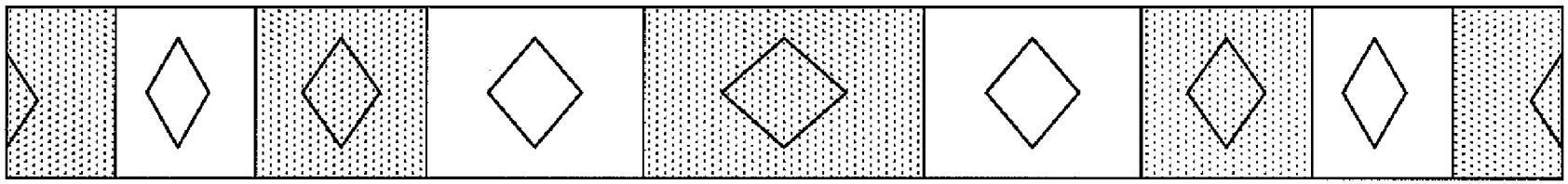
FIG. 2 is a side-view picture, which illustrates the side-view of circular array structure in accordance with one embodiment of the present invention.
Figure 3:
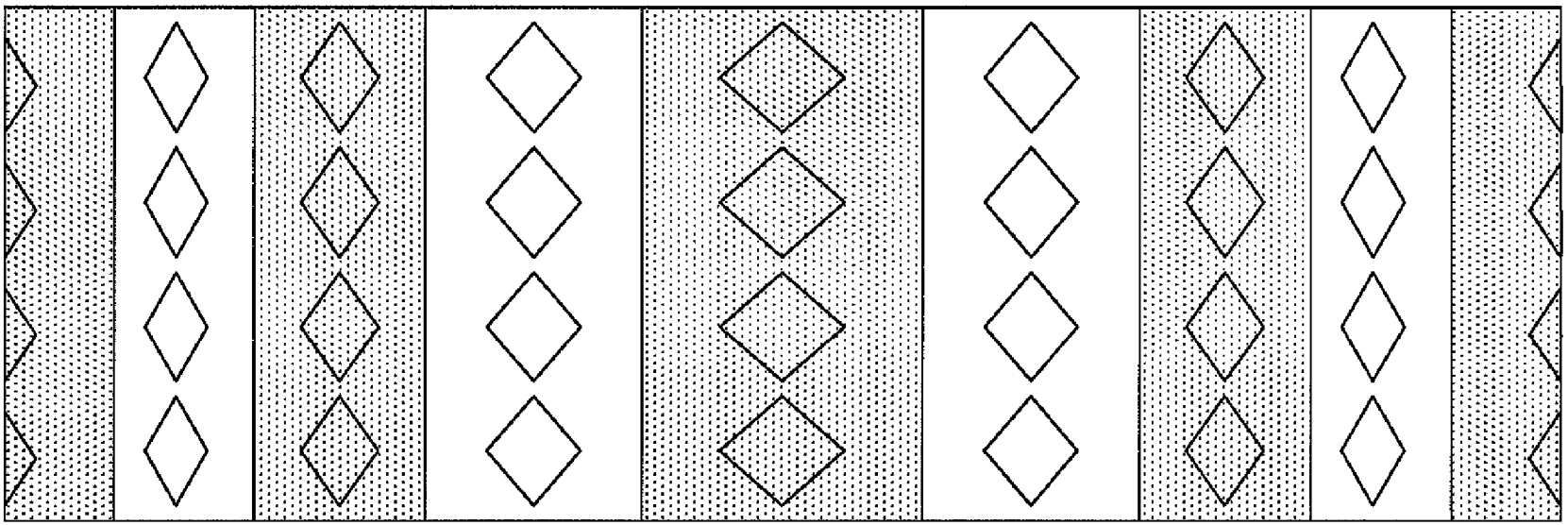
FIG. 3 is a side-view picture, which illustrates the side-view of cylindrical array structure in accordance with one embodiment of the present invention.
Figure 4:
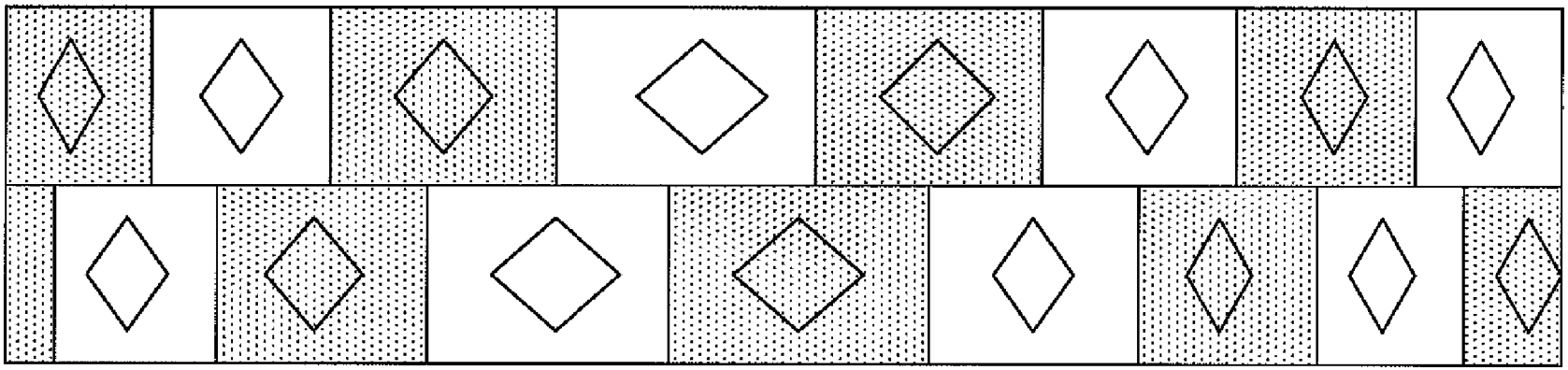
FIG. 4 is a side-view picture, which illustrates the side-view of stacked and interleaved circular array structures in accordance with one embodiment of the present invention.
Figure 5:
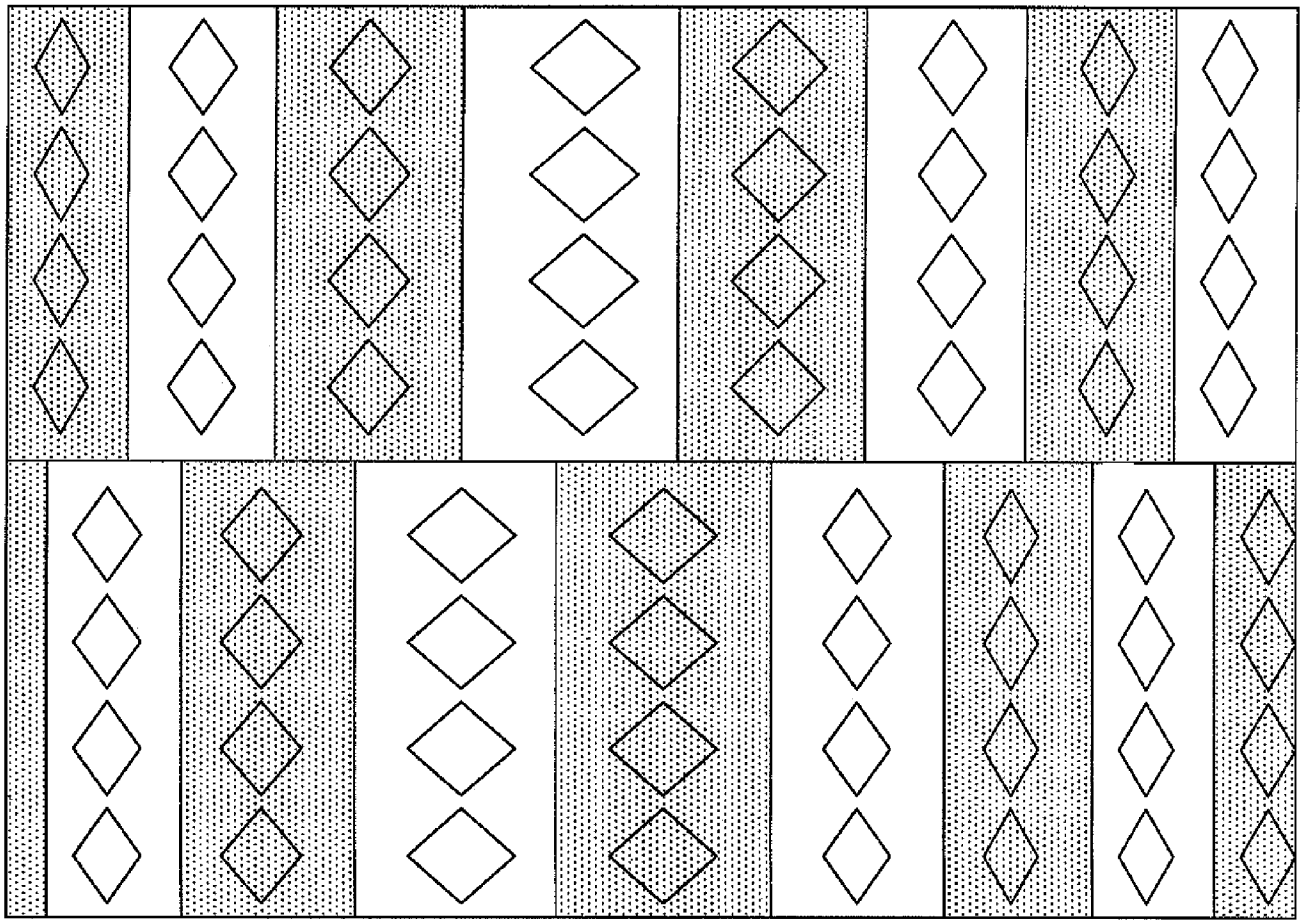
FIG. 5 is a side-view picture, which illustrates the side-view of stacked and interleaved cylindrical array structures in accordance with one embodiment of the present invention.

Referring to FIG. 2, which is a side-view picture, illustrates the side-view of circular array structure of the present invention. In this figuration, each rectangular block represents the whole aperture of array element (the antenna mounting panel), and the diamond block refers as the location of the antenna in array element, i.e. patch antenna for example. Similarly, referring to FIG. 3, which is a side-view picture of cylindrical array structure of the present invention. The cylindrical array structure is typically constructed by pluralities stacking layers of the circular array structure as shown in FIG. 2. The main difference between two configurations is the type of the array element (patch versus patch array), and the beam coverage of each configuration will be suitable for different applications in various environments. Besides, the array structure of the present invention further can be mounted as a stacked and interleaved formation, and the exemplary of these embodiments of formations are recited in FIG. 4 and FIG. 5. The embodiment of FIG. 4 is configured by two stacking layers of the circular array structure with interleave configuration. Alternatively, the embodiment of FIG. 5 is constructed by two stacking layers of the cylindrical array structure of FIG. 3 with interleave configuration.

Figure 6:
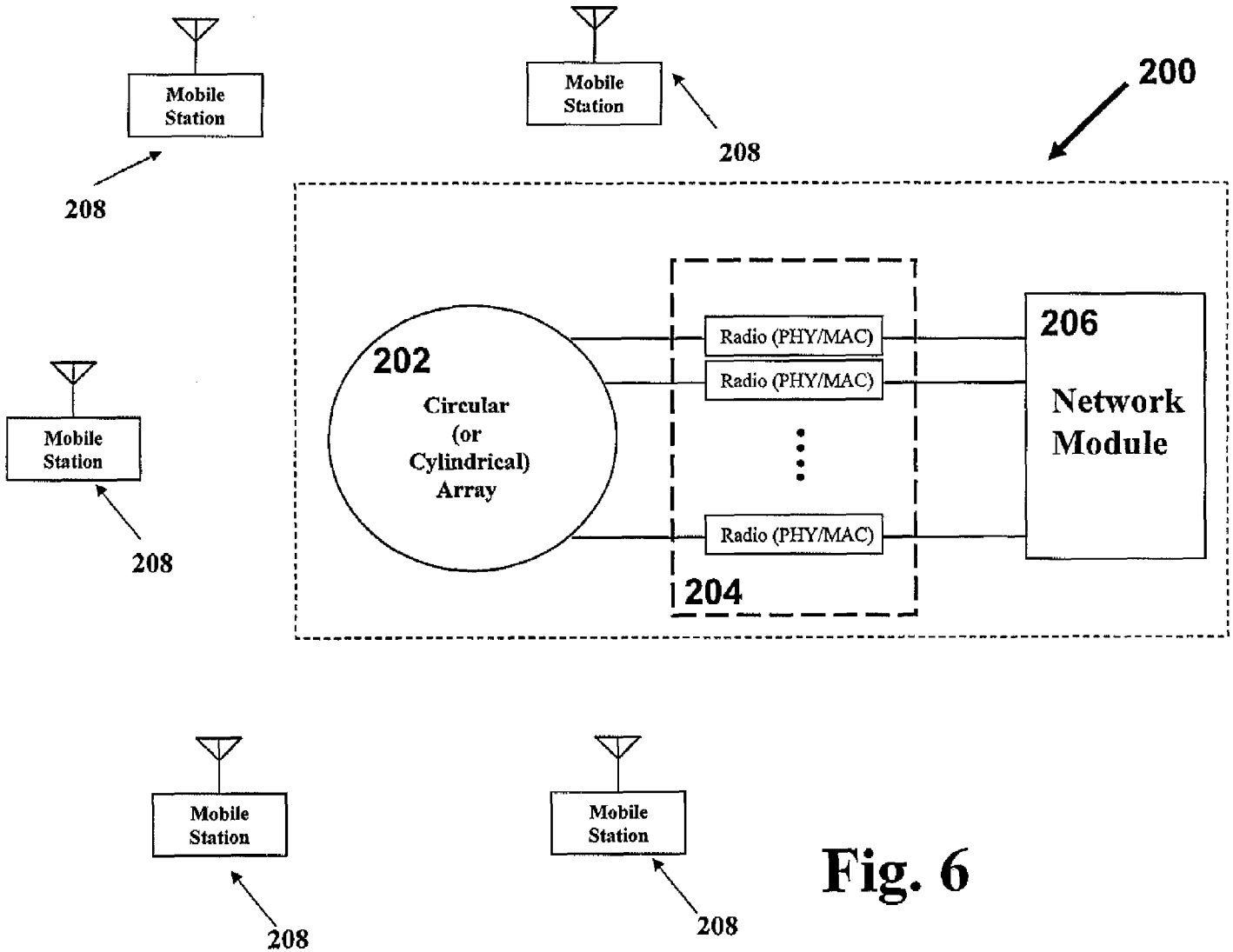
FIG. 6 is a block diagram, which illustrates one of the preferred applications in accordance with one embodiment of the present invention.

Referring to FIG. 6, which is a block diagram, illustrates one of the preferred applications in accordance with the present invention. The wireless station 200 includes a circular array structure 202 coupled to a radio signal module 204, and the radio signal module 204 is subsequent coupled to a network module 206. Moreover, there are plural mobile stations 208 in FIG. 6, the mobile stations 208 stand for other wireless device which is compatible with the wireless station 200. The circular array structure 202 further includes multiple array elements and the beam forming networks. The array elements can be phased arrays or attenuated arrays. Furthermore, the relative beam forming networks should be implemented according to array elements' type, and the implementation is optional. With regards to circular array structure, it can simultaneously form multiple beams to cover omni-direction azimuths and all azimuths in board or narrow elevations. After the beams are successfully formed by the beam forming networks, the beam will transfer to the radio module 204 in order to parse into useful formats. The radio module 204 comprises the physical and media access control layer for transmitting the beams. The network module 206 is able to switch all the incoming and outgoing beams, and all communication between each device is bi-directional.

Figure 7:
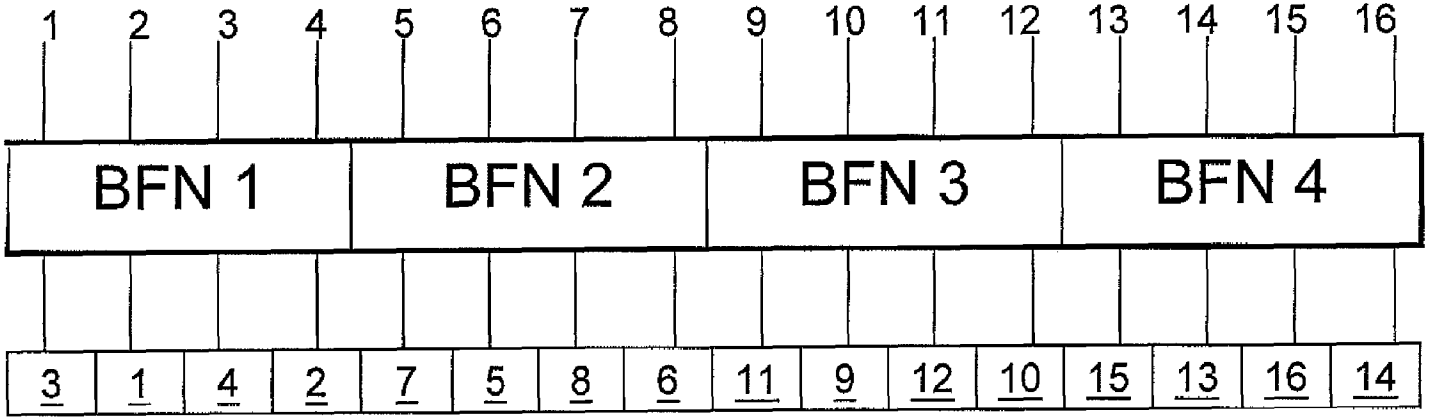
FIG. 7 is a block diagram, which illustrates one of the preferred embodiments of the present invention with four contiguous 4-ports butler matrices.
Figure 8:
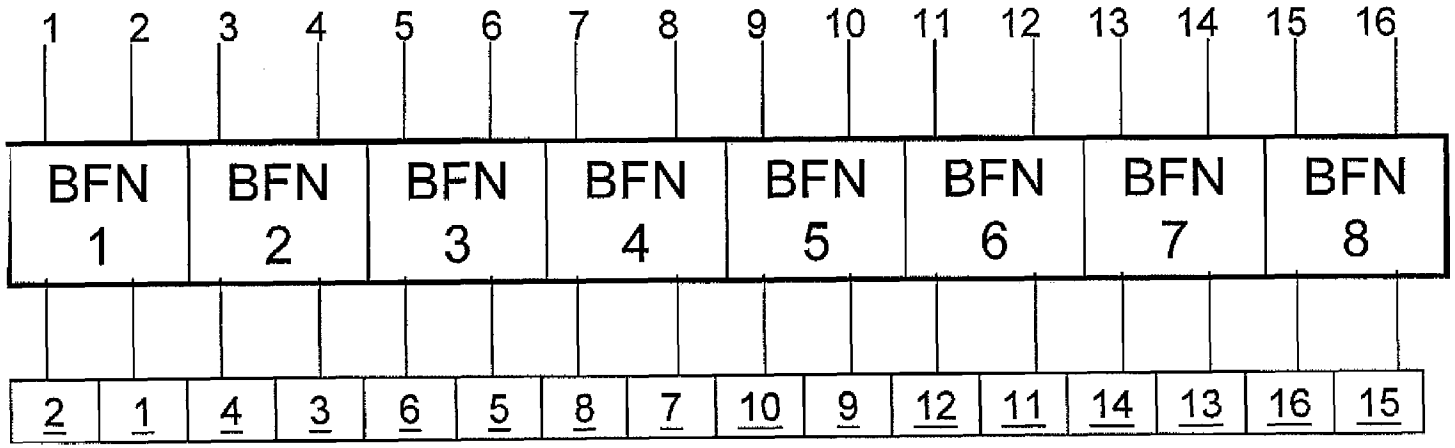
FIG. 8 is a block diagram, which illustrates one of the preferred embodiments of the present invention with eight contiguous 2-ports 90° hybrid couplers.

As aforementioned description, when the array structure is using the phased array as the array element, the corresponding beam forming network can be implemented in the butler matrices or the 90° hybrid couplers. The following paragraphs recite the detail connection between the antenna and the antenna ports of the beam forming network, and more the selection of the acceptable beams. First, referring to FIG. 7, which is a block diagram, illustrates one of the preferred embodiments of the present invention with four contiguous 4-ports butler matrices. The upper numerals in the FIG. 7 represent the numbering of the array elements, and four 4 ports-beam forming networks (labeled as BFN1, BFN2, BFN3 and BFN4) are used in this embodiment, besides there are 16 array elements in this embodiment. Each beam forming network is implemented with butler matrices, and the lower numerals with underlines in the FIG. 7 represent the output beams of the beam forming networks, furthermore the circumscribed numerals stand for the chosen beams of the present invention. In another implementation of the beam forming networks, referring to the FIG. 8, which is a block diagram, illustrates one of the preferred embodiments of the present invention with eight contiguous 2-ports 90° hybrid couplers. The upper numerals in the FIG. 8 represent the numbering of the array elements, and eight 2-ports 90° hybrid couplers (labeled as BFN1, BFN2, BFN3, BFN4, BFN5, BFN6, BFN7 and BFN8) are used in the embodiment, as well as to pre-mentioned description there also are configured with 16 array elements.

Figure 9:
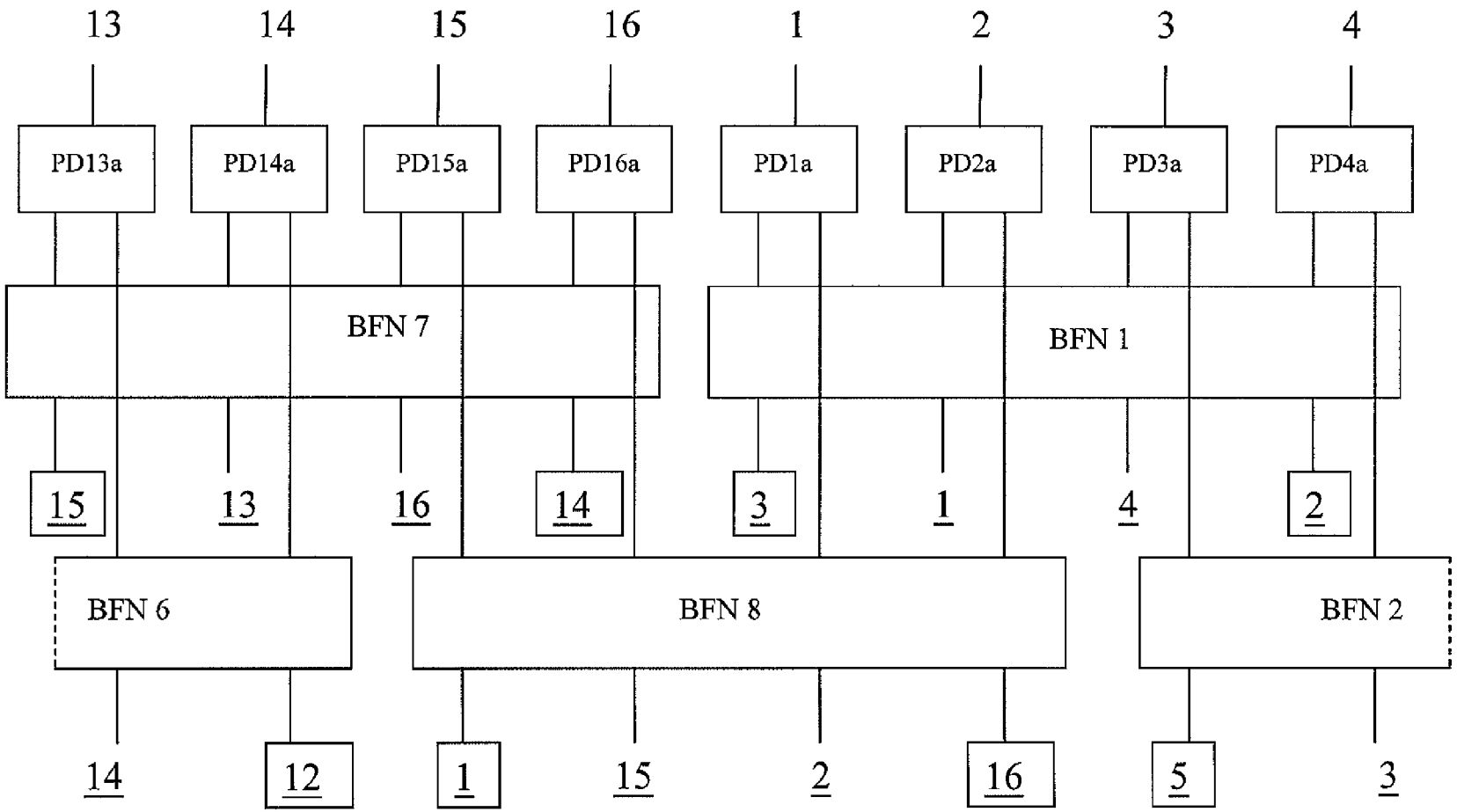
FIG. 9 is a block diagram, which illustrates portion of the preferred embodiment of the present invention with staggered 4-ports butler matrices.
Figure 10:
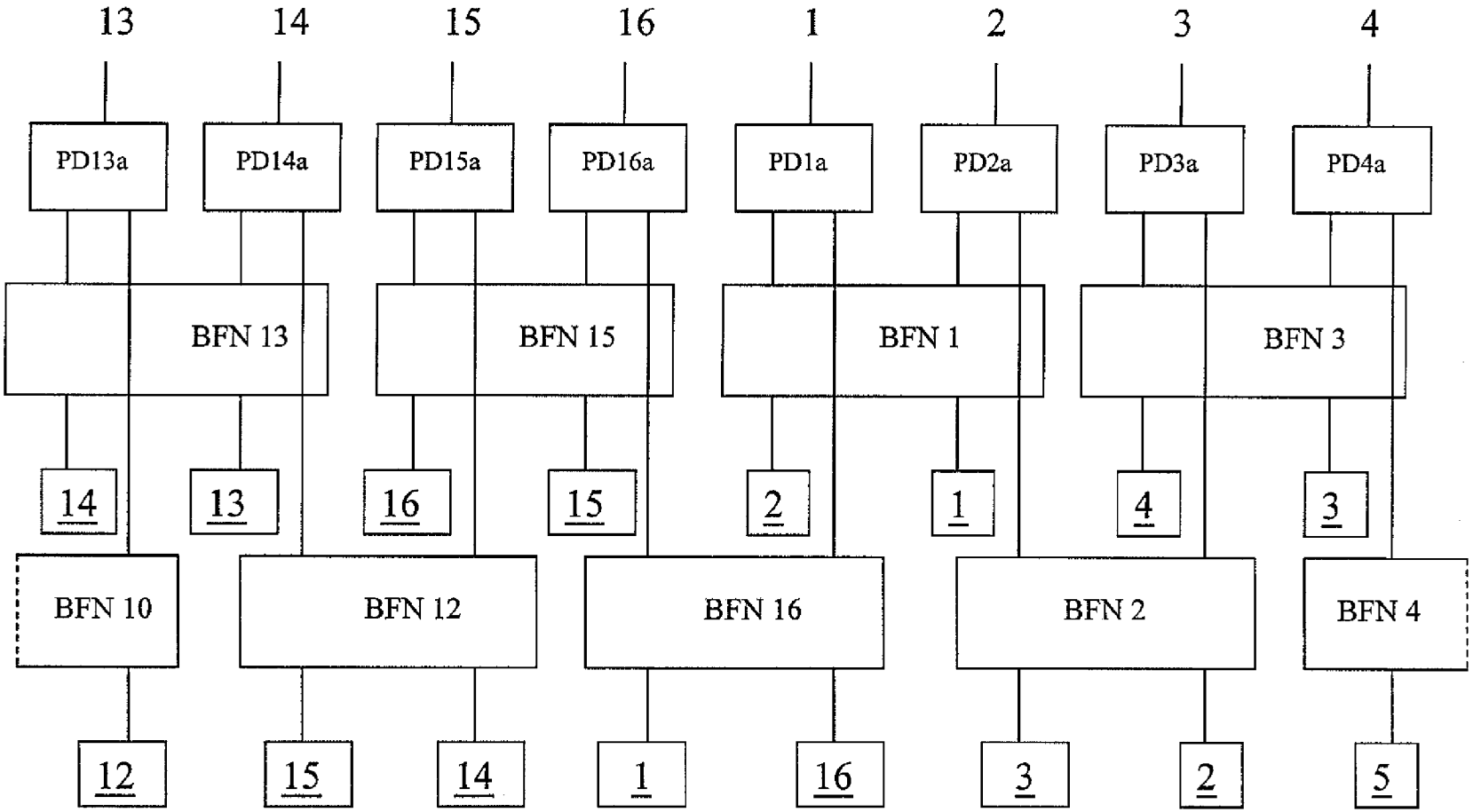
FIG. 10 is a block diagram, which illustrates portion of the preferred embodiment of the present invention with staggered 2-ports 90° hybrid couplers.

If the manufacturers want to achieve better beams' qualities, they need to use more beam forming networks and choose the better beams, definitely it costs much more. The following several embodiments of the present invention, using different configurations to produce more available beams, so the manufacturers can choose a better beam among several choices. There is an important characteristic of the butler matrices; the butler matrices are more accurate in two sides more than in center. In order to compensate this, using more beam forming networks let chosen beam formed in the two sides of the butler matrices, also seen as "staggered" configuration. The reference related to the Butler Matrix can refer to the Article: J. Butler and R. Lowe, Beamforming Matrix Simplifies Design of Electronically Scanned Antennas" Electron. Design, Vol.9, No.7, April 1961, pp. 170-173. Referring to FIG. 9, which is a block diagram, illustrates portion of the preferred embodiment of the present invention with staggered 4-ports butler matrices. Each array element has a corresponding power divider (labeled as PD1*a*, PD2*a*, . . . , and PD16*a*) to create multiple input, and sends the pulse to the relative beam forming network to sure all beam formed in the two sides of the 4-ports butler matrix. The circumscribed numerals with underline are representing the chosen beams. Referring to FIG. 10, which is a block diagram, illustrates portion of the preferred embodiment with staggered 2-ports 90° hybrid couplers. Although the 2-ports 90° hybrid couplers do not have the problem like the 4-ports butler matrix, we still can enhance the beam quality by creating more beams. As further descriptions, radio power is first divided into two paths by the power divider (labeled as PD1*a*, PD2*a*, . . . , and PD16*a*,) then beam forming networks produce beams. So every array elements will be available with two beams, and by connecting additional analyzers the good beam will be chosen.

Figure 11:
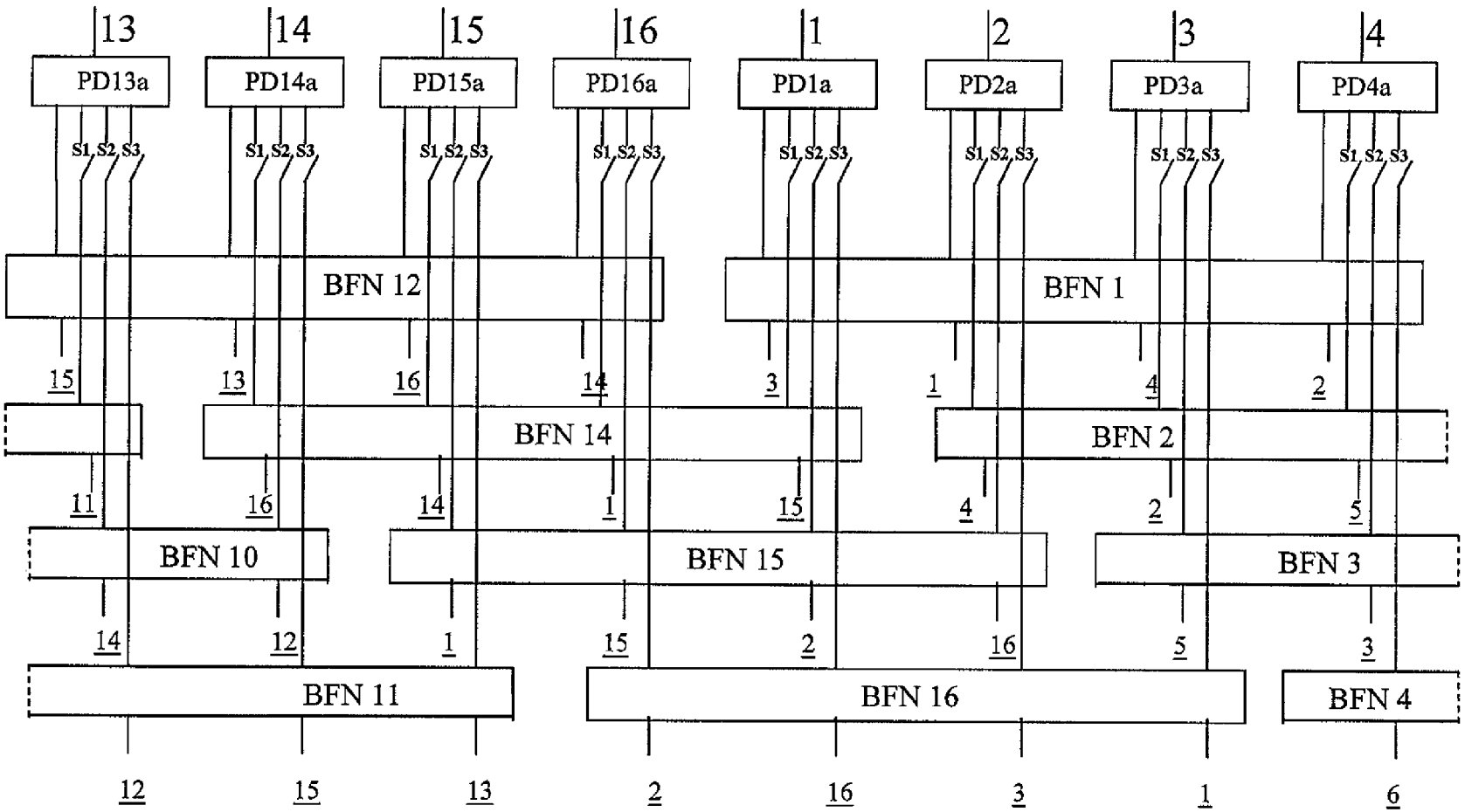
FIG. 11 is a block diagram, which illustrates portion of the selectable BFN (beam forming network) of the present invention with 4-ports butler matrices.
Figures 1, 12:
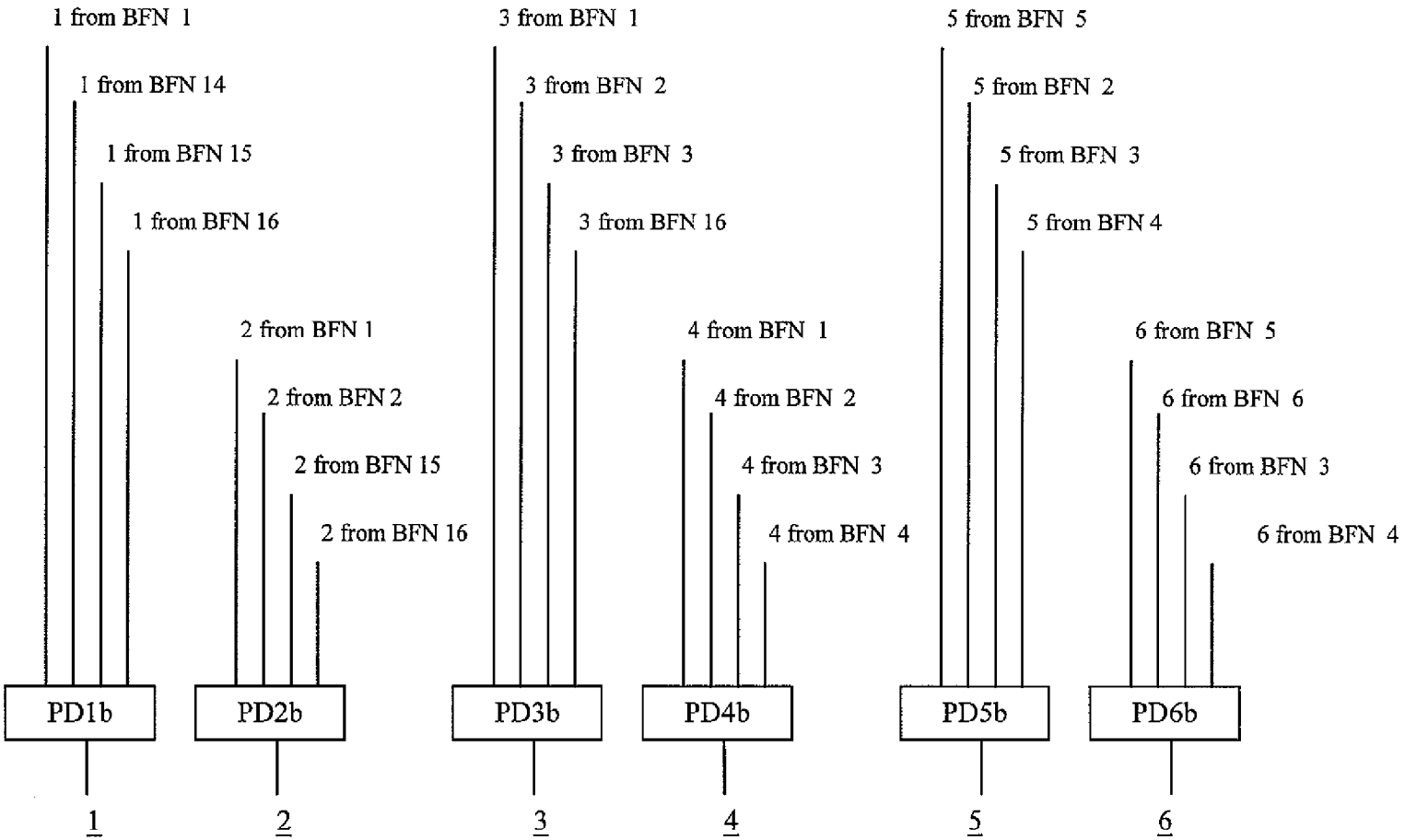
Figures 2, 12:
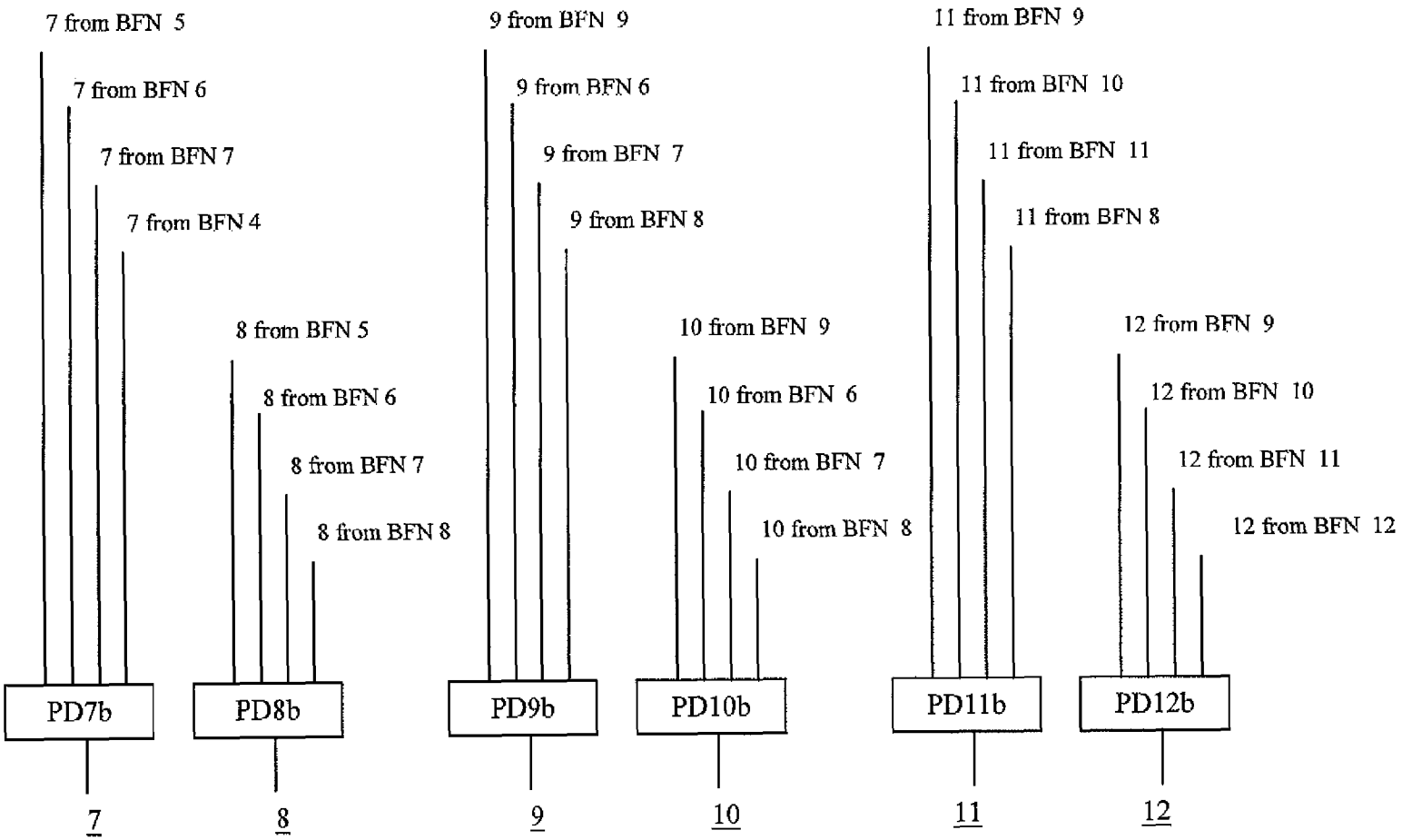
Figures 3, 12:
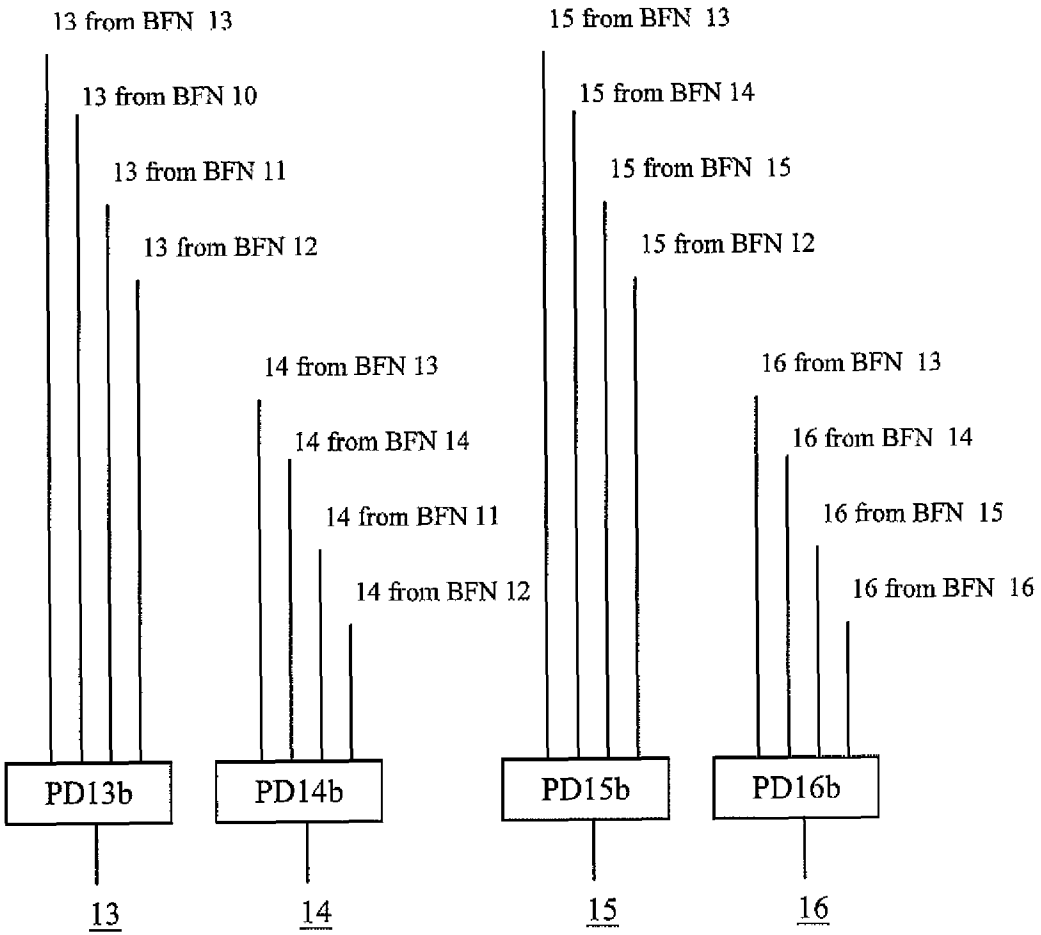
Figure 13:
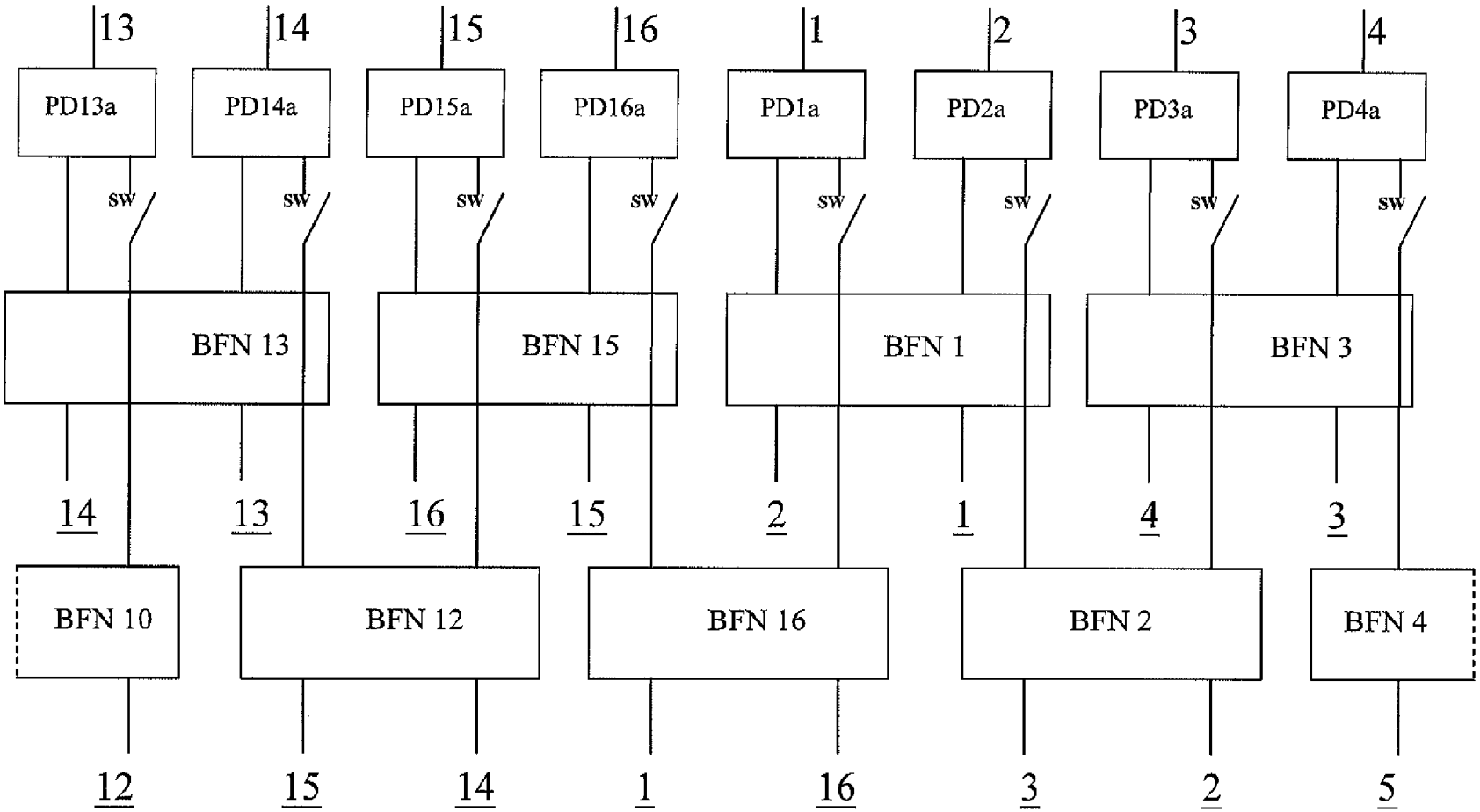
FIG. 13 is a block diagram, which illustrates portion of the selectable BFN of the present invention with staggered 2-ports 90° hybrid couplers.
Figures 1, 14:
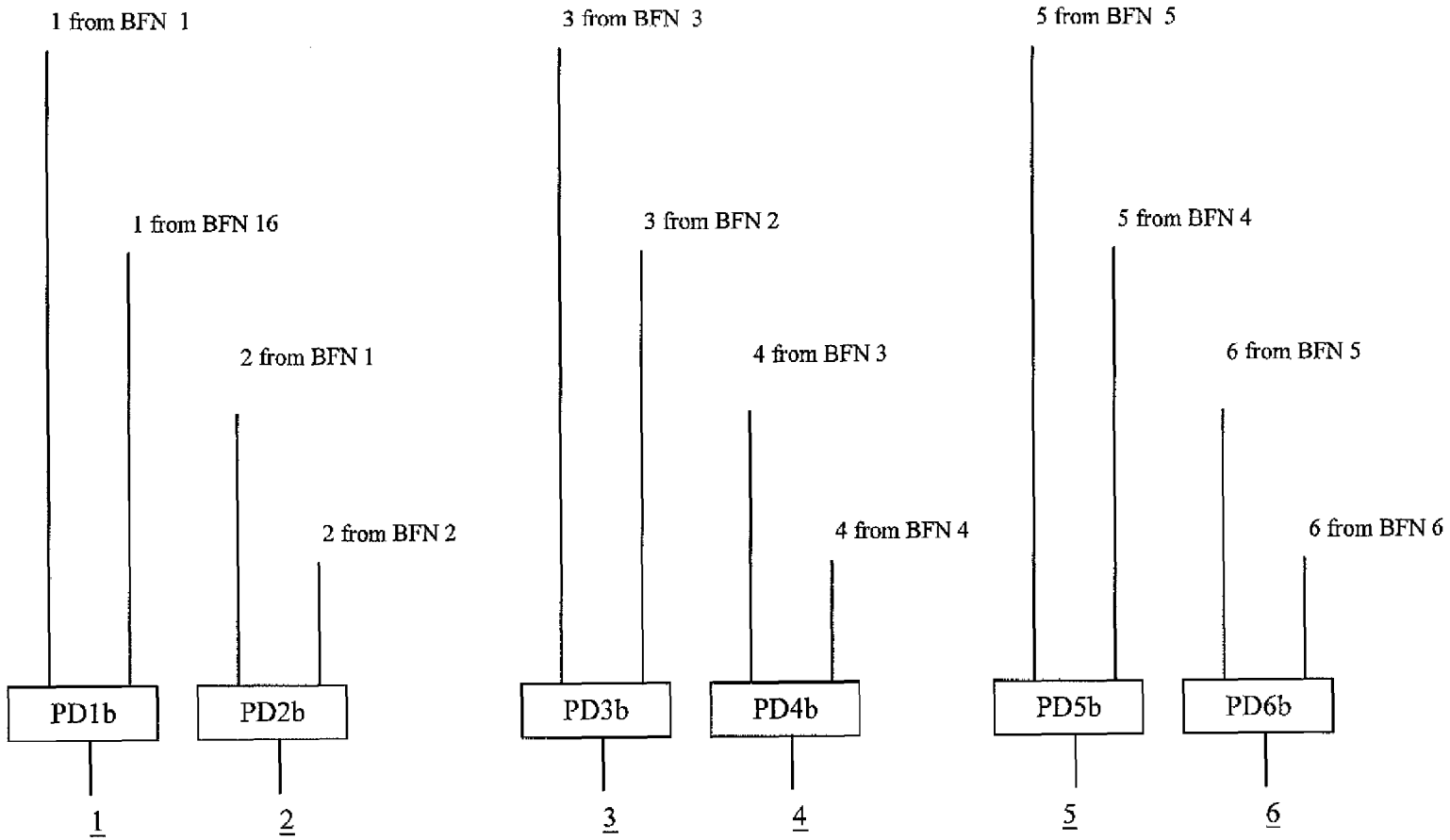
Figures 2, 14:
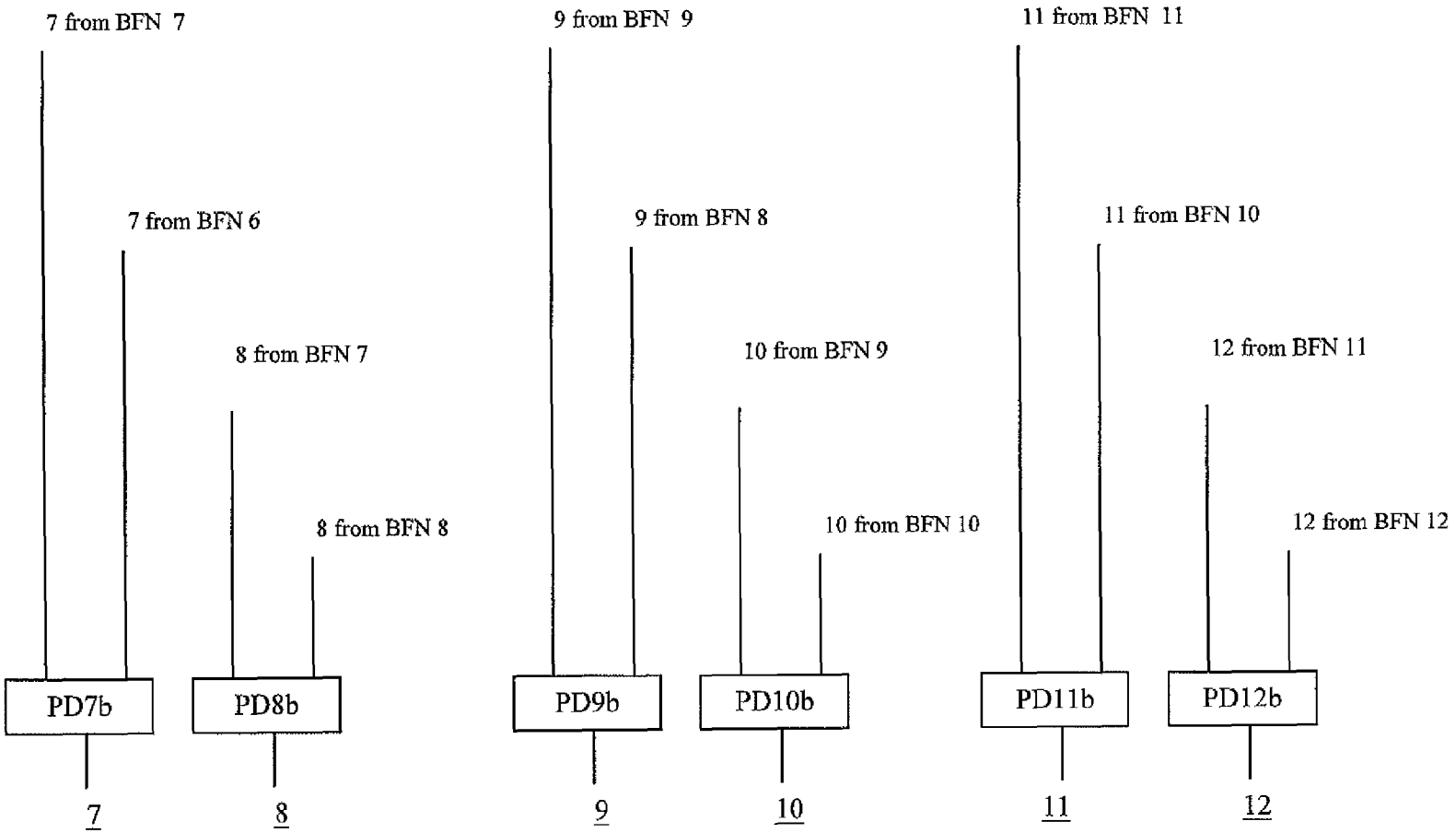
Figures 3, 14:
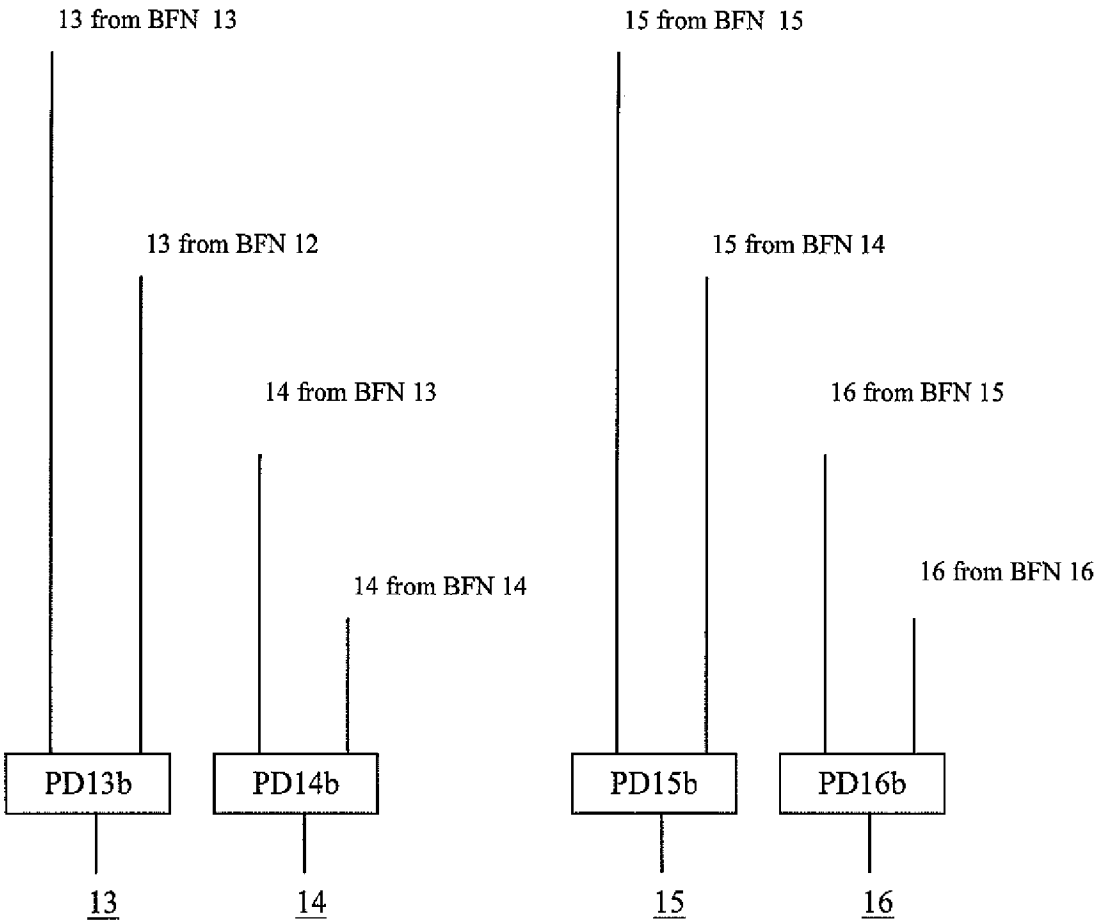

Referring to FIG. 11, which is a block diagram, illustrates portion of the selectable BFN (beam forming network) of the present invention with 4-ports butler matrices. In this configuration, it can achieve all aforementioned purposes by changing the switch. The radio power is sent to a power divider (labeled as PD1*a*, PD2*a*, . . . , and PD16*a*) to distribute the power into four paths, then first path is directly sent to beam forming networks, the remain paths are coupled with additional switch (labeled as SW1, SW2, SW3.) The connecting orders between the power divider and the beam forming networks can be understood by refereeing the FIG. 12-1, FIG. 12-2 and FIG. 12-3. For example, the first array element is connected to BFN1, BFN14, BFN15 and BFN16, and the connection of other array element can also be seen in figurations. When all switches (SW1, SW2, SW3) are opened, the whole beam forming networks work as the contiguous four 4-ports butler matrices in the FIG. 7. Besides by closing SW2 and opening SW1, SW3, the beam forming network can be set as staggered 4-ports butler matrices with steps of 2 antenna elements in the FIG. 9, this will give more accuracy the contiguous ones. Furthermore, by closing SW1, SW2 and SW3, the beam forming network can be set as staggered 4-ports butler matrices with steps of 1 antenna elements, this will give more accuracy and more array gain than contiguous ones.

Besides, the beam forming network with 2-ports 90° hybrid couplers also can be configured as selectable one, referring to the FIG. 13, FIG. 14-1, FIG. 14-2, and FIG. 14-3. The connection is just in a similar configuration with the butler matrices, it needs additional beam forming networks, power dividers and switches. When the switch is opened, the beam forming network is set as contiguous 2-ports 90° hybrid couplers (as the FIG. 8.) Moreover, when the switch is closed, the beam forming network is set to staggered 2-ports 90° hybrid couplers with steps of 1 antenna element (as the FIG. 10,) which can give more array gain than contiguous ones.

Figure 15:
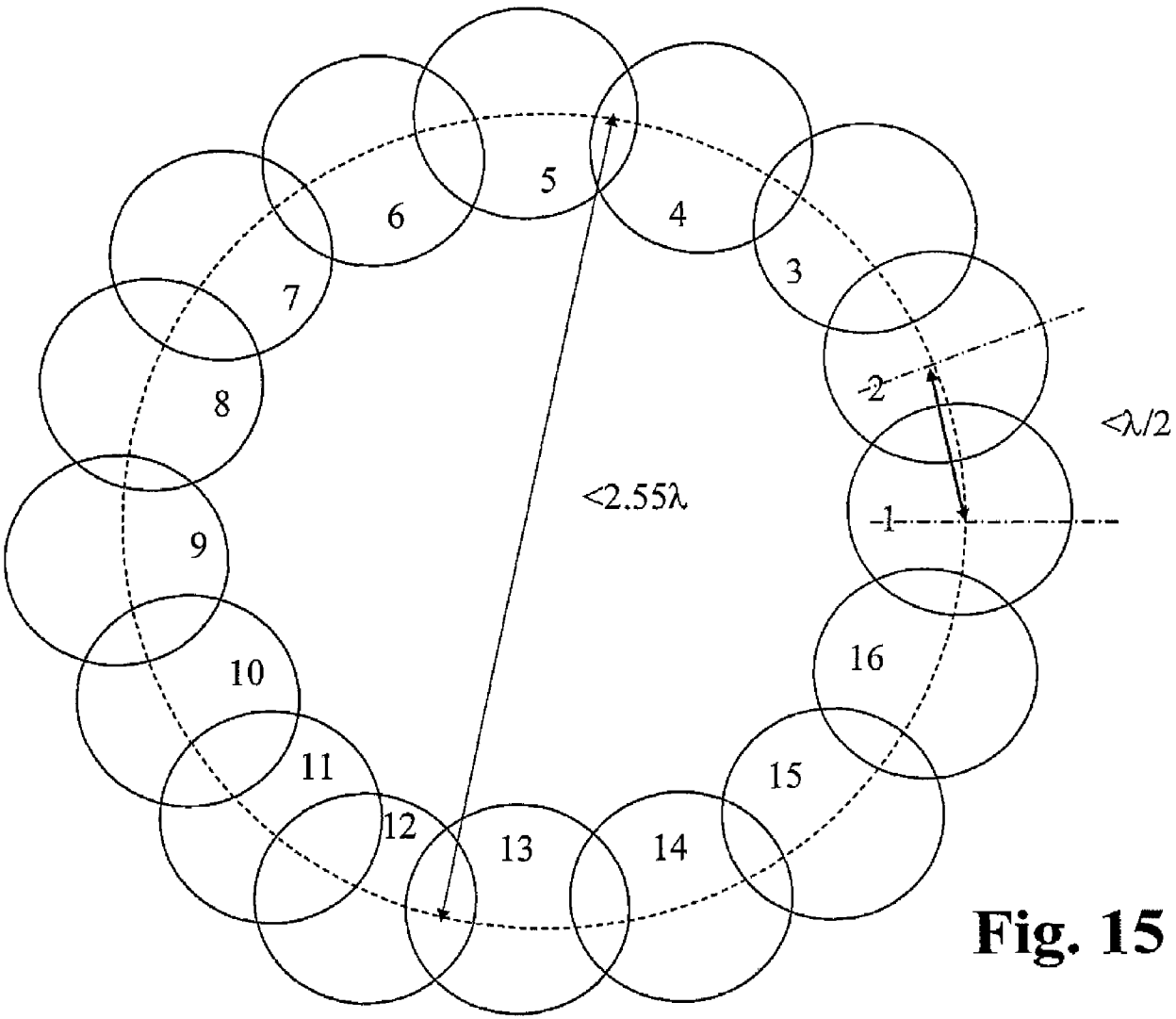
FIG. 15 is a block diagram, which illustrates an exemplary array structure with 16 attenuated array elements in accordance with one embodiment of the present invention.
Figure 16:
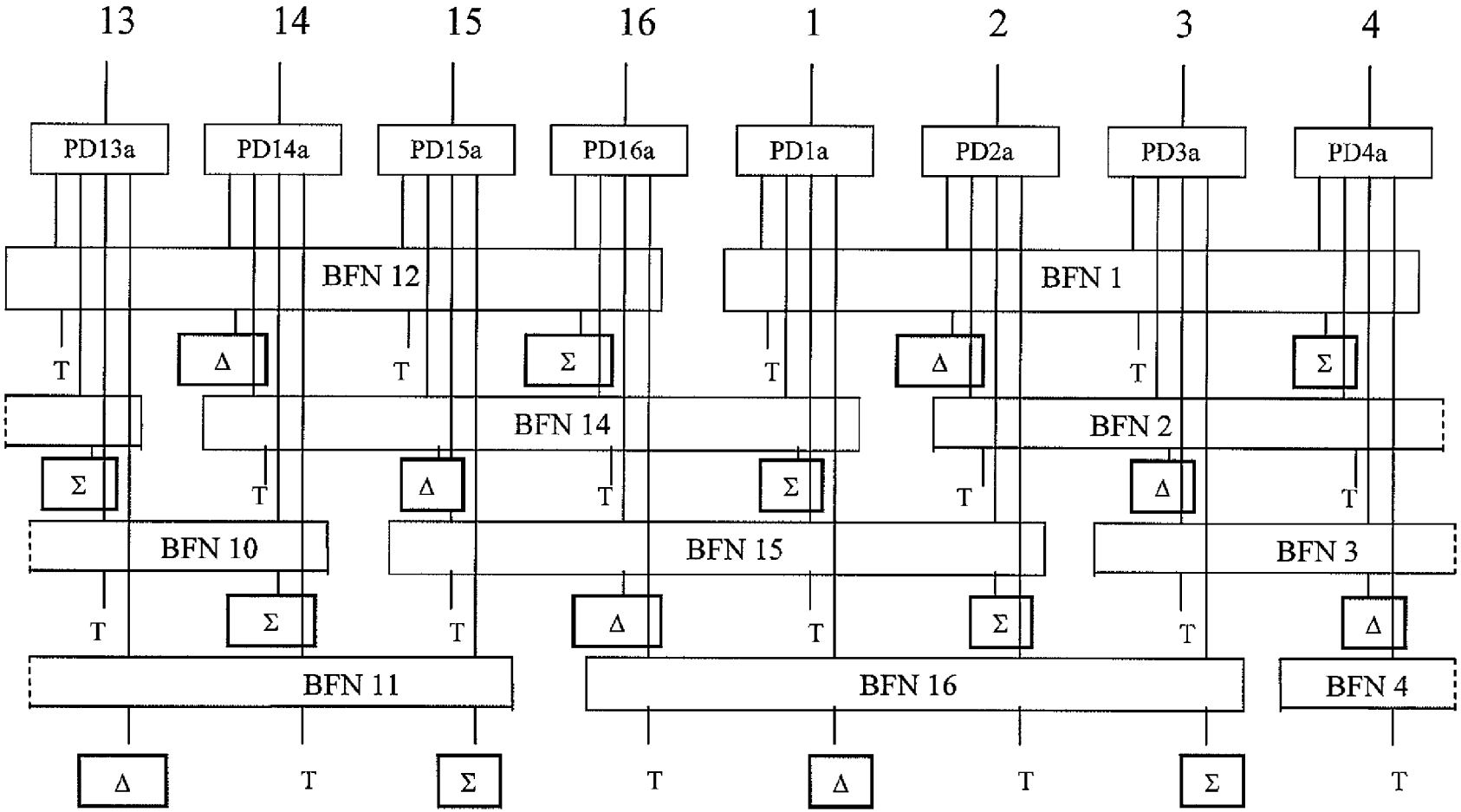
FIG. 16 is a block diagram, which illustrates the partial BFN of one of the preferred embodiment of the present invention with staggered 4-ports microwave comparators.
Figure 17:
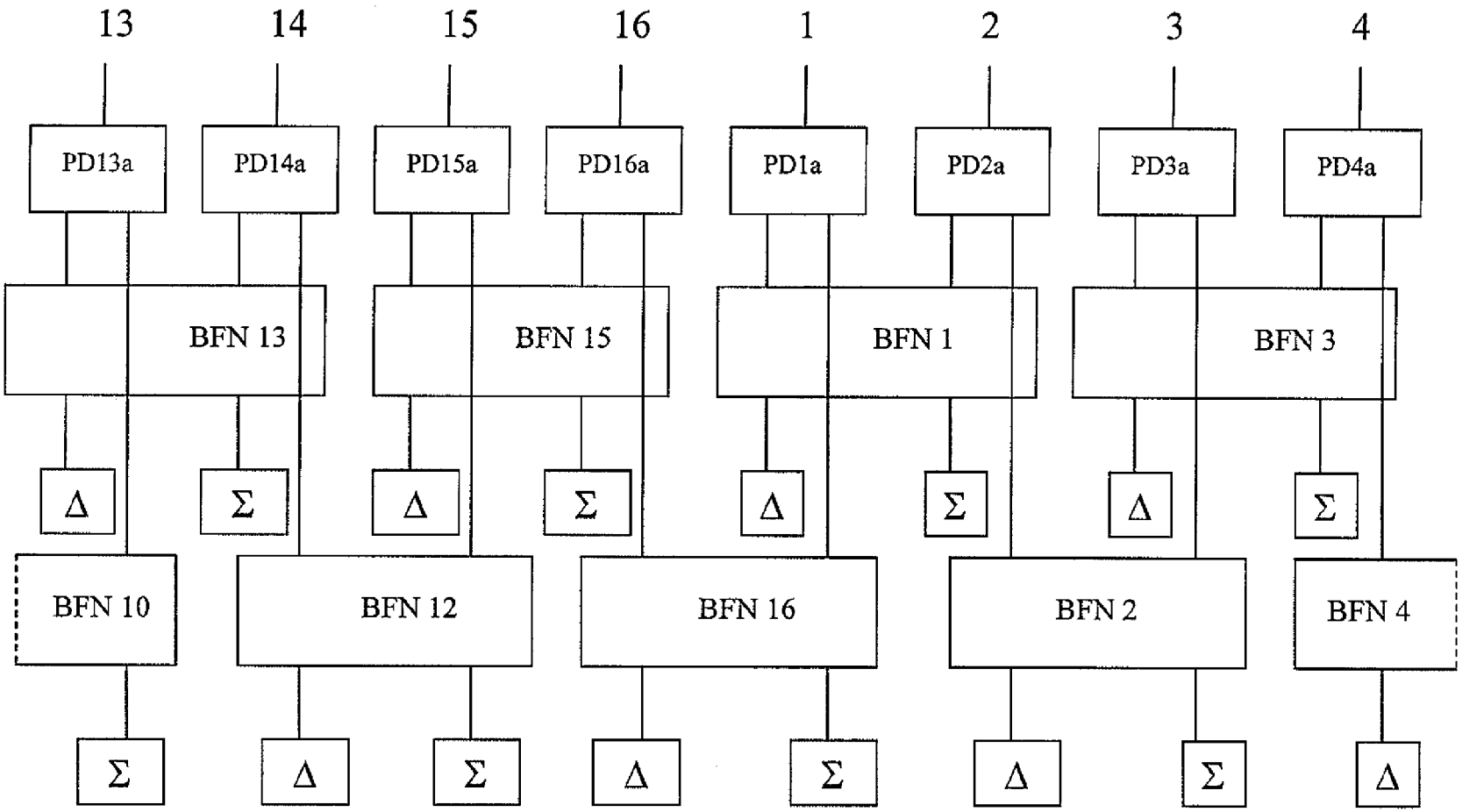
FIG. 17 is a block diagram, which illustrates the partial BFN of the preferred embodiment of the present invention with staggered 2-ports Magic-T couplers.

Another embodiment of the present invention is to employ attenuated array as array elements, referring to the FIG. 15, which is a block diagram, illustrates an exemplary array structure with 16 attenuated array elements in the present invention. Attenuated antenna arrays are mounted on a type of circle or a cylinder configuration which has a diameter comparing with the wavelength. If the antenna element has a small number as 8, antenna spacing can be less than 0.5λ, or if the antenna element has a large number as 16, the antenna spacing can be kept to be less than 0.5λ by the design of 2-layer stacking (as shown in the FIG. 15) and 360°/16-step interleaving. When attenuated array is used as array element, the corresponding beam forming network can be implemented by multiple microwave comparators with port number less than the number of the antenna element; the contiguous configuration can not be used, and only the staggered configuration can be used. Referring to the FIG. 16, is a block diagram, illustrates the partial BFN of one of the preferred embodiment of the present invention with staggered 4-ports microwave comparators. Each array element has a corresponding power divider (labeled as PD1*a*, PD2*a*, . . . , and PD16*a*) to create multiple input, and sends the RF power to the relative beam forming network to sure all beam formed in the 4-ports microwave comparators. The circumscribed characters (Σ, Δ) with "mark" are representing the chosen beams. Furthermore, the microwave comparators can be replaced by the Magic-T couplers, referring to the FIG. 17, which is a block diagram, illustrates the partial BFN of the preferred embodiment with staggered 2-ports Magic-T couplers.

TABLE 1

| | Embodiment A | Embodiment B |
|---|---|---|
| Antenna array configuration | 1) Phased-array<br>2) Only spacing between elements in linear array<br>3) Both spacing and squint angle between elements in circular array | 1) Attenuated-array<br>2) Squint angle between elements in both linear and circular arrays<br>3) Small spacing between elements in both linear and circular arrays cannot be avoided if antenna elements have big aperture sizes compared with mounting object |
| Antenna element trimming | Each element needs to be trimmed in phase (Phased) to | Each element needs to be trimmed in attenuation |

TABLE 1-continued

| | Embodiment A | Embodiment B |
|---|---|---|
| method | form the beam | (Attenuated) to form the beam |
| Direction Finding scheme | Phase-comparison | Amplitude-comparison |
| Beam Forming Network Type | 1) Butler Matrix<br>2) 90° Hybrid<br>3) Others | 1) Microwave Comparator<br>2) Magic-T<br>3) Others |
| Accuracy of B/F and D/F | 1) Phased-arrays in both linear and circular orientations are more accurate in center than in two sides<br>2) Butler Matrix is more accurate in two sides than in center | 1) Attenuated-arrays have equal accuracy in both linear and circular orientations<br>2) Microwave Comparator Accuracy is not deviated |
| Efficiency | 1) Array gain can be high provided that directional antennas are used<br>2) Beam forming gain is high<br>3) Insertion loss is low if use contiguous configurations of 4-port Microwave Comparator or 2-port 90° hybrid; medium if use staggered configurations | 1) Array gain is high since antennas are directional<br>2) Beam forming gain is fair<br>3) Insertion loss is high if use 4-port Microwave Comparator; medium if use 2-port Magic-T |
| Performance | 1) Isolation can depend on the orthogonalty of antenna array provided that antennas orthogonal in patterns are used<br>2) Isolation depends much on the orthogonalty of formed beams by Butler Matrix<br>3) Isolation depends on the cross-coupling around transmission-line crossover in and out of BFN | 1) Isolation depends on the orthogonalty of antenna array<br>2) Isolation depends a little on the orthogonalty of formaed beams by Microwave Comparator<br>3) Isolation depends on the cross-coupling around transmission-line crossover in and out of BFN |

The table 1 recites the differences between the preferred embodiment with phased arrays and the preferred embodiment with attenuated arrays. Besides, the antenna element gain and the antenna array gain should be all kept high. Moreover, the transmission loss can be kept low by using transmission lines, power dividers, beam forming network and so forth, with individual low insertion losses. Isolation among the beam ports of the beam forming network can become inherently high when using butler matrices of that the orthogonal beams are formed by a hard-wire equivalent to a Discrete Fast Fourier Transform. Isolations among input ports and among output ports of power dividers, and among antenna ports and among beam ports of beam forming network can be kept high further by using well shielded coaxial cables or well isolated strip-lines. Isolations among antenna elements can be kept high if there is orthogonalty or quasi-orthogonalty among their radiation patterns. Furthermore, isolations between each crossover transmission line pair in the Butler Matrices can be kept high by using well shielded coaxial cables or well isolated strip-lines. Finally, Isolation can be increased further by using high-isolated parts as power dividers, phase-shifters, couplers, switches, comparison circuits and so forth.

Figure 18:
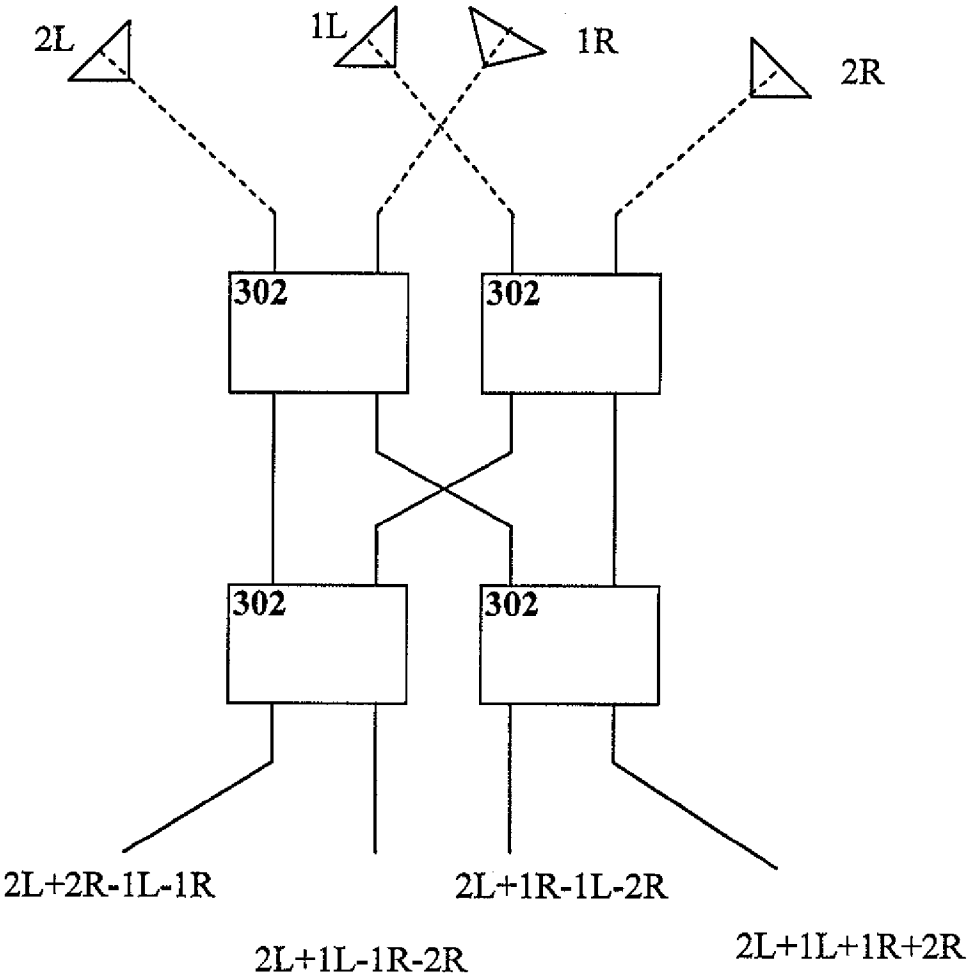
FIG. 18 is a block diagram, which illustrates 4-element attenuated array plus 4-port microwave comparators (analyzer is not shown.)
Figure 19:
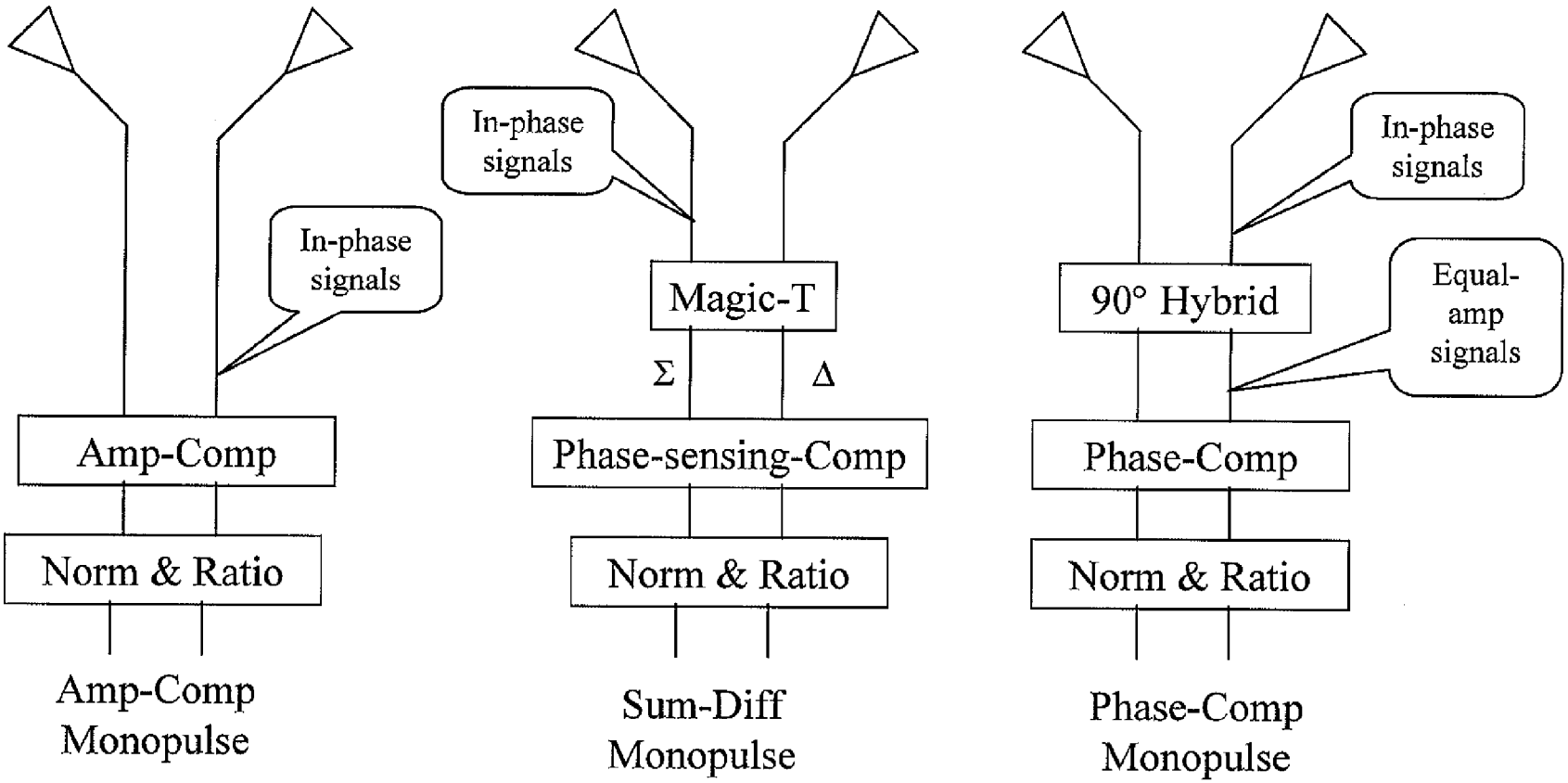
FIG. 19 is a block diagram, which several monopulse schemes.

Furthermore, referring to the FIG. 18 and the FIG. 19, both illustrate the further connection for signal comparisons. First, the FIG. 18 illustrates 4-element attenuated array plus 4-port microwave comparators 302 (analyzer is not shown.) And there are the antenna element spacing<0.5λ, the squint angle=11.25°, the beamwidth=22.5° and the antenna coverage=90°. Then, about the FIG. 19, recites the signal transfer and comparison, as comparing with phase, comparing with sum-difference or comparing with amplitude. Besides, the table 2 is the antenna bore-sight angle of the FIG. 18.

TABLE 2

| Beam | Bore-sight Angle |
|---|---|
| 2R | +33.75° |
| 1R | +11.25° |
| 1L | −11.25° |
| 2L | −33.75° |

Other embodiments of the invention will be apparent to those skilled in the art from consideration of the specification and practice of the invention. The word "comprising" and forms of the word "comprising" as used in the description and in the claims are not meant to exclude variants or additions to the invention. Furthermore, certain terminology has been used for the purposes of descriptive clarity, and not to limit the present invention. The embodiments and preferred features described above should be considered exemplary, with the invention being defined by the appended claims.

Having described the invention, the following is claimed:

1. An array structure, comprising:

a plurality of array elements configured in a circular or cylindrical configuration, wherein the adjacent space between said plurality of array elements is substantially half of the radio wavelength of said plurality of array elements, and the diameter of said circular or cylindrical configuration is greater than the radio wavelength of said plurality of array elements; and a plurality of beam forming networks, coupled to antenna ports of said array elements to deliver the formed beams to wireless local area network or wireless metro area network applications through beam ports thereof, for simultaneously forming multiple beams to cover omni-direction azimuths and all azimuths in board or narrow elevations.

2. The array structure of claim 1, wherein said array elements comprise phased arrays.

3. The array structure of claim 2, wherein said beam forming networks comprise butler matrices and 90° hybrid couplers.

4. The array structure of claim 2, wherein said beam forming network includes a contiguous 4-ports butler matrices.

5. The array structure of claim 2, wherein said beam forming network includes a contiguous 2-ports 90° hybrid couplers.

6. An array structure, comprising:

a plurality of array elements configured in a circular or cylindrical configuration, wherein the adjacent space between said plurality of array elements is substantially half of the radio wavelength of said plurality of array elements, and the diameter of said circular or cylindrical configuration is greater than the radio wavelength of said plurality of array elements;

a plurality of input power dividers coupled to antenna ports of said array elements; and a plurality of beam forming networks, coupled to output ports of said input power dividers to deliver the formed beams to wireless local area network or wireless metro area network applications though beam ports thereof, for simultaneously forming multiple beams to cover omni-direction azimuths and all azimuths in board or narrow elevations.

7. The array structure of claim 6, wherein said beam forming network includes a staggered 4-ports butler matrices.

8. The array structure of claim 6, wherein said beam forming network includes a staggered 2-ports 90° hybrid couplers.

9. The array structure of claim 6, further comprising:

plurality of switches coupled to said output ports of said input power divider and antenna ports of said beam forming network.

10. The array structure of claim 9, wherein said beam forming network includes a staggered 4-ports butler matrices.

11. The array structure of claim 9, wherein said beam forming network includes a staggered 2-ports 90° hybrid couplers.

12. An array structure, comprising:

a plurality of array elements configured in a circular or cylindrical configuration, wherein the adjacent space between said plurality of array elements is smaller than a half of the radio wavelength and said array elements comprise attenuated arrays;

a plurality of input power dividers coupled to antenna ports of said array elements; and a plurality of beam forming networks, coupled to output ports of said input power divider to deliver the formed beams to wireless local area network or wireless metro area network applications through beam ports thereof, for simultaneously forming multiple beams to cover omni-direction azimuths and all azimuths in board or narrow elevations.

13. The array structure of claim 12, wherein said beam forming network includes a staggered microwave comparators.

14. The array structure of claim 12, wherein said beam forming network includes a staggered Magic-T couplers.

* * * * *